US007735232B2

(12) United States Patent
Bahler

(10) Patent No.: US 7,735,232 B2
(45) Date of Patent: Jun. 15, 2010

(54) BED-DEPTH GAUGE

(75) Inventor: Philip J. Bahler, Tolland, CT (US)

(73) Assignee: ToolBro Innovators LLC, South Windsor, CT (US)

( * ) Notice: Subject to any disclaimer, the term of this patent is extended or adjusted under 35 U.S.C. 154(b) by 99 days.

(21) Appl. No.: 12/231,181

(22) Filed: Aug. 29, 2008

(65) Prior Publication Data

US 2009/0178288 A1 Jul. 16, 2009

Related U.S. Application Data

(63) Continuation-in-part of application No. 29/294,520, filed on Jan. 15, 2008, now Pat. No. Des. 577,975.

(51) Int. Cl.
*E04F 21/20* (2006.01)
*G01B 5/18* (2006.01)

(52) U.S. Cl. ..... 33/518; 33/562

(58) Field of Classification Search ..... 33/501.09, 33/501.45, 518, 521, 526, 533, 545, 546, 33/562, 567, 567.1; 52/749.13; 404/118; D10/64, 70, 71
See application file for complete search history.

(56) References Cited

U.S. PATENT DOCUMENTS

| | | | | |
|---|---|---|---|---|
| 209,399 | A | 10/1878 | Hurlburt | |
| 584,860 | A | 6/1897 | Dowble | |
| 1,222,188 | A | 4/1917 | DeAvilia | |
| 1,361,677 | A | 12/1920 | Brown | |
| 2,112,432 | A | 3/1938 | Baumann | |
| 2,543,716 | A * | 2/1951 | Carini | 33/518 |
| 2,682,791 | A | 7/1954 | Lahaie | |
| 2,759,268 | A * | 8/1956 | Cook | 33/568 |
| 2,761,217 | A * | 9/1956 | King | 33/342 |
| 3,030,738 | A * | 4/1962 | Brewer et al. | 52/749.13 |
| D325,177 | S | 4/1992 | Vogrig | |
| D336,253 | S | 6/1993 | Economaki | |
| D339,971 | S | 10/1993 | Hatcher | |
| 5,419,057 | A * | 5/1995 | Jackson | 33/562 |
| 5,465,498 | A * | 11/1995 | Lycan | 33/645 |
| 5,671,553 | A | 9/1997 | Burkhart | |
| D400,453 | S | 11/1998 | Holland | |
| D426,235 | S | 6/2000 | Phirippidis et al. | |
| 6,381,908 | B1 * | 5/2002 | Fisher | 52/127.2 |
| 6,412,185 | B1 | 7/2002 | Mills et al. | |
| D517,575 | S | 3/2006 | Maschke | |
| 7,192,216 | B2 | 3/2007 | Casale | |
| 7,472,492 | B1 * | 1/2009 | Vecchio | 33/562 |
| 2003/0159301 | A1 * | 8/2003 | Lawson | 33/526 |

FOREIGN PATENT DOCUMENTS

EP 1486754 A2 * 12/2004

* cited by examiner

*Primary Examiner*—R. A. Smith
(74) *Attorney, Agent, or Firm*—Ira S. Dorman

(57) ABSTRACT

A bed-depth gauge consists of a guide member, a screed member, and means for assembling them for relative movement, for effective depth adjustment, in a vertical direction that is generally perpendicular to a bottom edge of the screed member. The guide member has a pair of arms that extend laterally, at different heights, which are used to engage and follow a fixed reference surface to thereby enable the bottom edge of the screed member to level and control the depth of both a base layer and also an overlying upper layer, comprising a bed prepared for installation of paving blocks and the like.

10 Claims, 5 Drawing Sheets

BED-DEPTH GAUGE

CROSS-REFERENCE TO RELATED APPLICATION

This application is a continuation-in-part of application Ser. No. 29/294,520, filed Jan. 15, 2008 now U.S. Pat. No. D,577,975, the entire specification of which is incorporated hereinto by reference thereto.

BACKGROUND OF THE INVENTION

In constructing patios, walks, or the like, using pavers such as blocks, bricks, stones, tiles, etc. (hereinafter referred to comprehensively as "pavers"), the quality of the underlying base is of paramount importance. Normally, pavers are placed on a bed that consists of a relatively course particulate bottom layer and a relatively fine particulate top layer, typically provided by gravel and sand, respectively.

The depth and uniformity of those layers are very important to the quality of the finished installation, and various tools have in the past been proposed and provided in an effort to achieve uniformity and depth control. Representative of the prior art in the field are the following United States patents: U.S. Pat. No. 219,399, to Hurlburh; No. 584,860 to Dowble; No. 1,222,188, to De Avilia, No. 1,361,677, to Brown; No. 2,112,432, to Baumann; No. 2,682,791, to Emile; No. 5,671,553 to Burkhart; No. 6,412,185 to Mills et al.; No. 7,192,216 to Casale; D325,177 to Vogrig; D339,971 to Hatcher; D336,253 to Economaki; D400,453 to Holland; D426,235 to Phirippidis et al.; and D517,575 to Maschke.

SUMMARY OF THE INVENTION

It is the primary object of the present invention to provide a bed-depth gauge that is effective for use in distributing materials for forming both the base layer of a bed for installation of pavers, and also a top layer, with both layers being uniform and of controlled depth.

It is also an object of the invention to provide such a bed-depth gauge having the foregoing features and advantages which, in addition, is very convenient and facile to use, allows the installer to reliably set and readily adjust its components so as to produce perfect depths based upon the height of the pavers being installed, and is of incomplex and inexpensive construction and manufacture.

It has now been found that certain of the foregoing and related objects of the invention are attained by the provision of a bed-depth gauge comprising: a guide member, a screed member, and means for assembling the guide member and the screed member with one another. The guide member comprises a panel portion having a front face, a rear face, a top edge, a bottom edge, and opposite lateral edges; the screed member has a front face, a rear face, a top edge, a (normally rectilinear) bottom edge, and opposite lateral edges; and the means for assembling secures the guide member and the screed member to one another with the rear face of the panel portion of the guide member contiguous to the front face of the screed member and for relative movement along a first axis (which is generally vertical in normal use of the gauge) so as to selectively vary the distance between the top edge of the guide member panel portion and the bottom edge of the screed member while maintaining the bottom edge at an angular orientation that is generally perpendicular to the "first" axis (i.e., generally horizontal in normal use). The guide member has first and second arms that extend laterally, in opposite directions, beyond the opposite lateral edges of both the guide member panel portion and also the screed member, and the bottom of each of the arms has a guide surface that extends substantially parallel to the bottom edge of the screed member. The guide surface of the first arm is spaced a first distance from the bottom edge of the guide member panel portion, and the guide surface of the second arm is spaced a second distance, less than the first distance, from the same edge. The guide member, the screed member, and the means for assembling are constructed, dimensioned, and configured so as to enable the guide member and screed member to be secured to one another throughout a range of positions in which the bottom edge of the screed member lies below (i.e., projects beyond) the bottom edge of the guide member panel portion.

In most embodiments, both the guide member panel portion and also the screed member of the tool are of thin, flat, planar, substantially rectangular construction, and are of substantially the same width; the contiguous faces of the panel portion and the screed member are normally in direct surface contact with one another. The means for assembling will usually comprise a pair of parallel slots, formed through either the guide member panel portion, the screed member, or both, and a pair of studs that extend, correspondingly, from the panel portion and/or the screed member through the parallel slots to provide free, projecting threaded end portions on which a pair of fasteners are engaged. In preferred embodiments, both of the slots are formed in the screed member and are oriented perpendicular to the rectilinear bottom edge thereof, both of the threaded studs extend from the panel portion of the guide member, and the threaded fasteners comprise hand knobs.

The first and second arms on the guide member will usually be of thin, flat, planar form and will extend parallel to the plane of the guide member panel portion (normally being coplanar therewith). Each of the arms will desirably include a planar contact element extending along the bottom edge thereof, disposed perpendicular to the plane of the arm and providing the guide surface thereon. At least the panel portion and the first and second arms of the guide member will most desirably be of one-piece, integrally formed construction.

In particularly preferred embodiments, the guide member will have indicia thereon indicative of the separate functions of the gauge that each of the first and second arms cooperates with the screed member in performing. More particularly, the indicia will typically comprise the word "BASE" on the first arm and the word "SAND" on the second arm. The screed member will desirably also have markings thereon that are indicative of the distance between the bottom edge of the screed member and the guide surfaces of the first and second arms. More specifically, the front face of the screed member will preferably have the distance-indicative indicia thereon, with the panel portion of the guide member having at least one aperture therein with and through which the distance-indicative indicia can be aligned and viewed.

DETAILED DESCRIPTION OF THE PREFERRED AND ILLUSTRATED EMBODIMENTS

Figure 1:
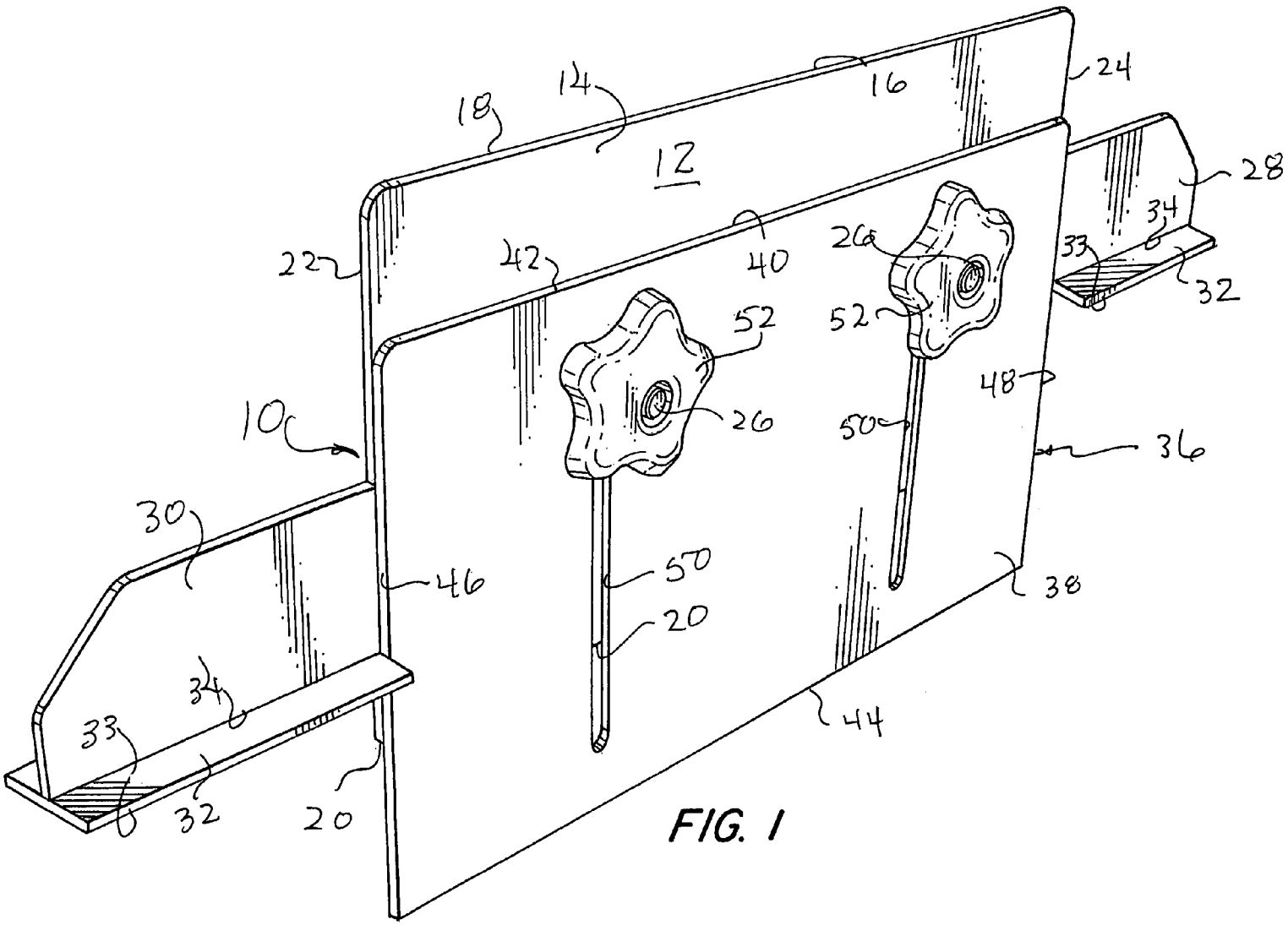
FIG. 1 of the drawings is a perspective view of a bed-depth gauge embodying the present invention.
Figure 2:
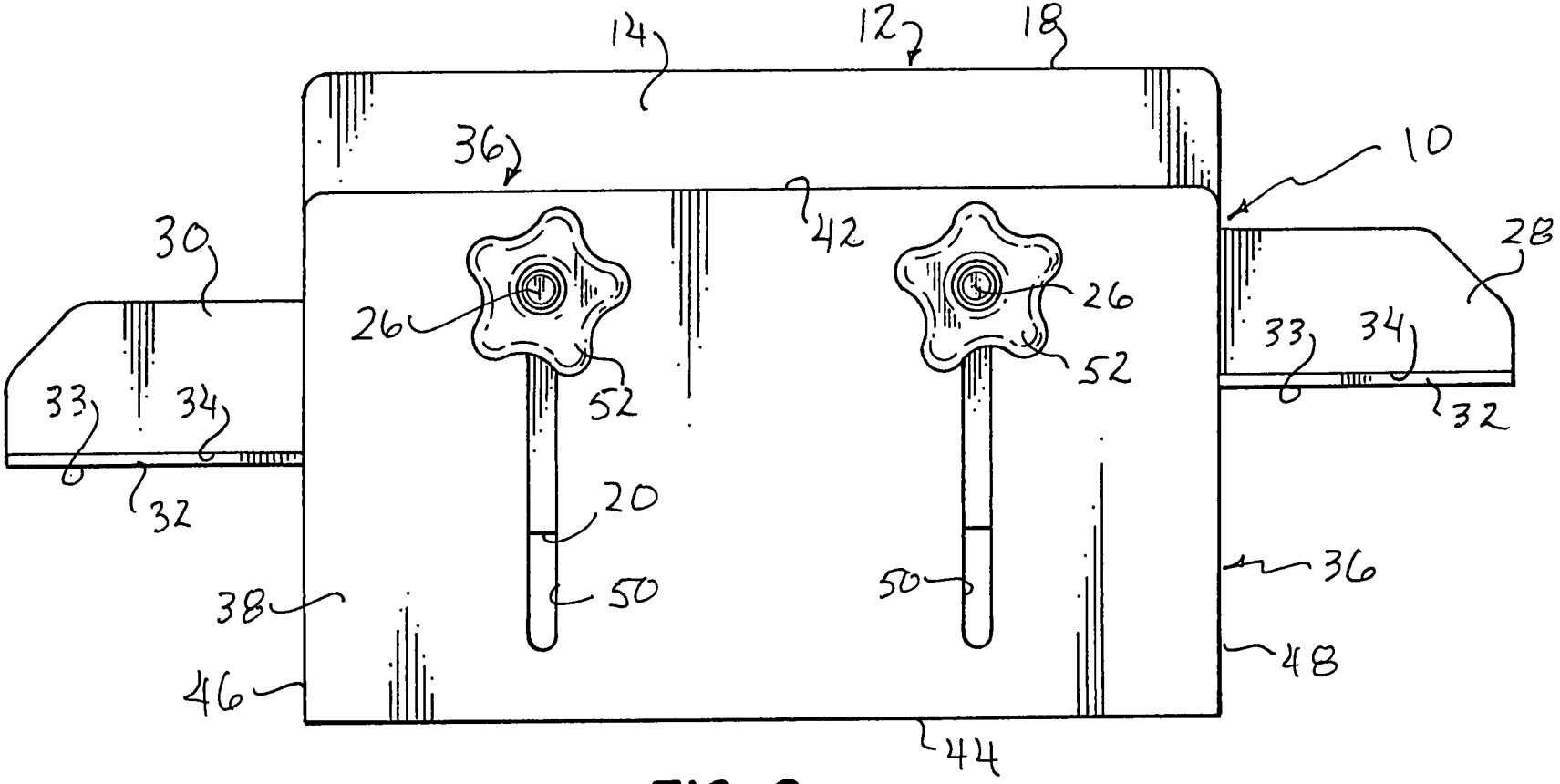
FIG. 2 is a front elevational view of the gauge of FIG. 1.

Turning now in detail to the appended drawings, therein illustrated is a bed-depth gauge embodying the present invention and consisting of a guide member, generally designated by the numeral 10, having a rectangular panel portion 12 which is of flat, relatively thin, planar form and has a front face 14, a rear face 16, a top edge 18, a bottom edge 20, and two opposite lateral edges 22 and 24. A pair of threaded studs 26 is attached to the panel portion 12 and extend forwardly, both at the same height (i.e., spaced equally from the bottom edge 20) and parallel to one another (i.e., normal to the plane of the panel portion 12). It will be appreciated that carriage bolts will conveniently be used to provide the studs 26, and that the panel portion 12 will correspondingly be provided with square openings to engage the collars under the heads of the bolts.

Extending in opposite directions from the panel portion 12 are a pair of arm portions 28, 30, which are coplanar, and integrally formed, with the panel portion 12. Each arm portion 28, 30 has a flat, rectilinear strip 32 of material attached to (or formed with) its bottom edge 34 and providing a guide surface 33. Fundamental to the invention is the fact that the arm portions 28, 30, and consequently the guide surfaces 33 thereon, are disposed at different levels on the panel portion 12 (i.e., with different spacing from the bottom edge 20); typically, the spacing differential would be approximately one inch (25 mm), representing the depth of the top layer of a paver bed produced using the gauge.

Cooperating with the guide member 10 is a screed member or blade, generally designated by the numeral 36, which is also of planar, rectangular form and has a front face 38 and a rear face 40 and is defined by top, bottom, and opposite lateral edges 42, 44, 46, 48, respectively. As will be noted, the screed blade 36 and the panel portion 12 of the guide member 10 are of essentially the same width and they are disposed with the rear face 40 of the blade 36 in full surface contact with the front face 14 of the panel portion 12.

A pair of parallel slots 50 are formed through the screed member 36 with an orientation perpendicular to the rectilinear bottom edge 44. The lateral spacing between the slots 50 is the same as that which exists between the studs (carriage bolts) 26 on the guide member 10, so as to cause the studs to extend through the slots 50 for receiving the internally threaded hand knobs 52 on their free end portions. As will be self-evident, the screed blade 36 is, as a result of the construction described, slidably mounted against the guide member 10 so as to enable facile variation of the spacing between the bottom edge 44 of the blade 36 and the guide surfaces 33 on the arm portions 28, 30 of the guide member 10. Needless to say, the blade 36 can be fixed in any selected position throughout its range of movement by tightening the knobs 52 on the carriage bolts 26 so as to cause them to bear against the front face 38 of the blade.

It will also be self-evident that, in use, the bed-depth gauge of the invention is simply run along a fixed reference surface (not shown) with which the guide surface 33 on one or the other of the arm portions 28, 30 is held in contact, so as to thereby cause the bottom edge 44 of the screed blade 36 to contact, level, and smooth the surface of an adjacent deposit of particulate material. More particularly, once the screed blade 36 has been affixed against the guide member 10 to establish the desired spatial relationship between the bottom edge 44 and the guide surfaces 33, the gauge would first be used to level, smooth, and bring to proper depth the base material (e.g., gravel), with the guide surface 33 of the more elevated arm portion 28 engaged with, and translated along, the fixed reference. The top layer material (e.g., sand) would then be deposited upon the base material, and the tool would again be run along the same reference surface (without changing the position of the screed blade 36 relative to the guide member 10) so as to thereby distribute the sand to produce a top layer of desired depth and surface character. The pavers would then of course be laid by placing them into the prepared bed, in a conventional manner.

Figure 3:
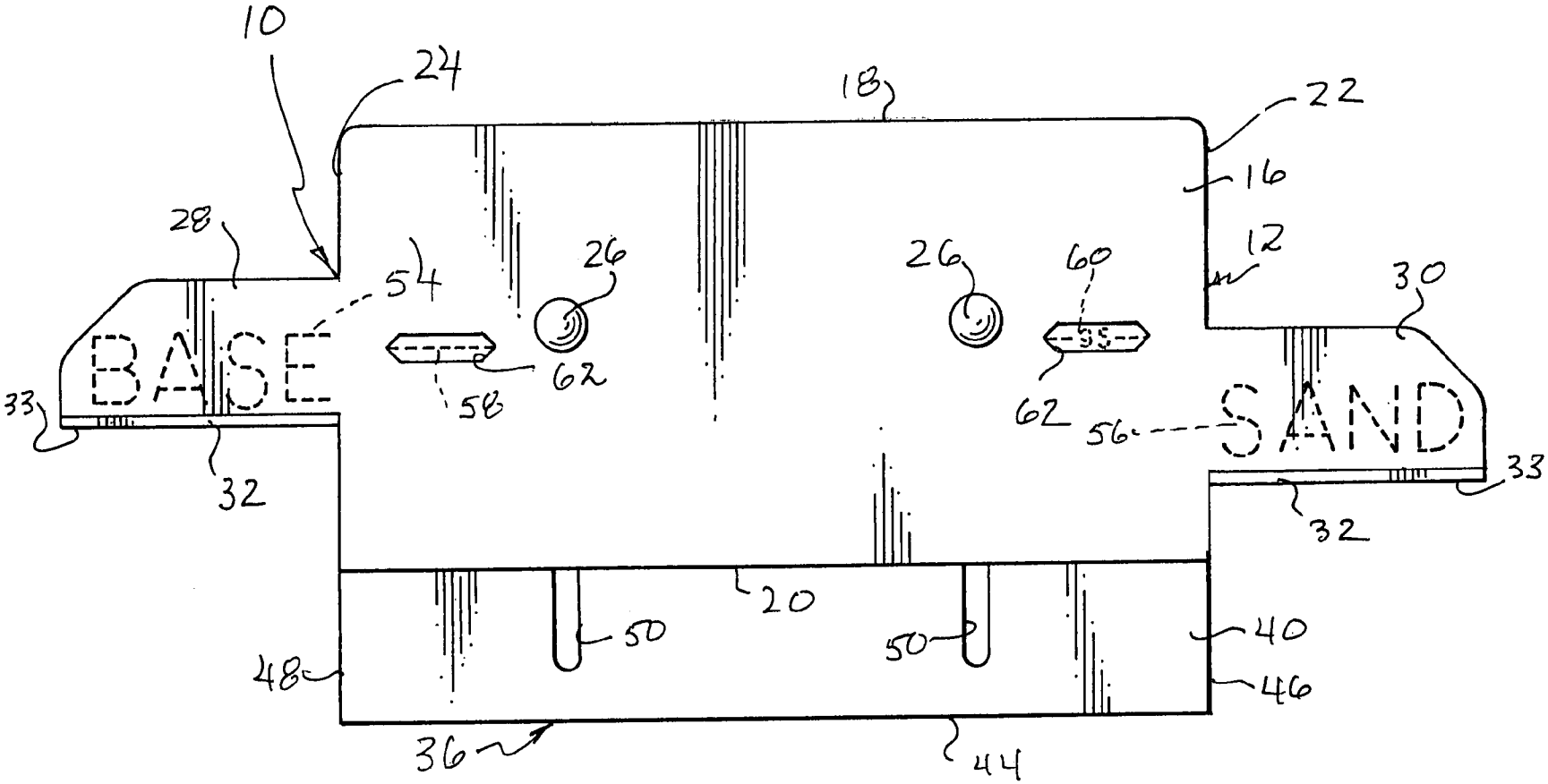
FIG. 3 is a rear elevational view of the gauge.
Figure 4:
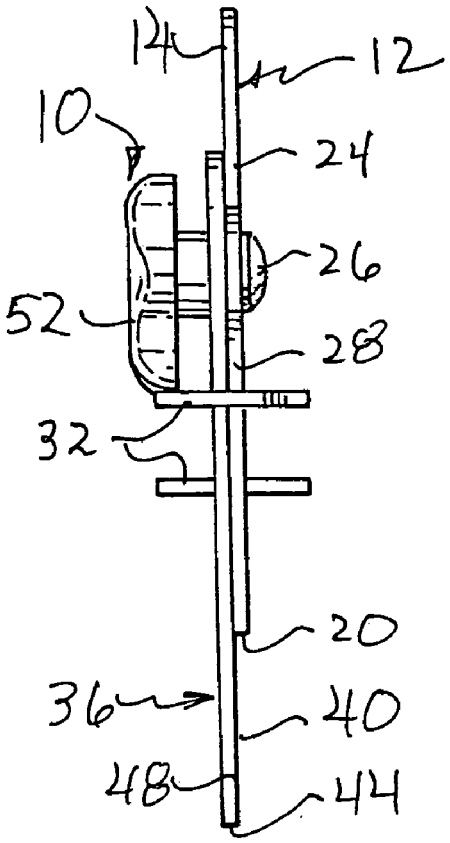
FIG. 4 is a right side elevational view of the gauge.
Figure 5:
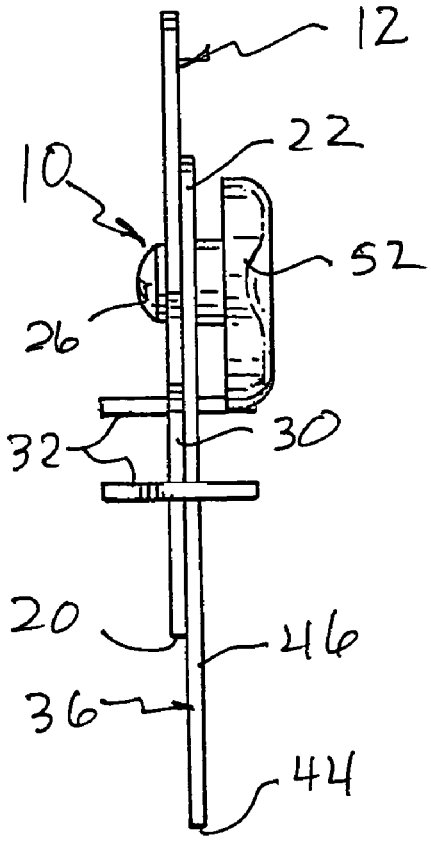
FIG. 5 is a left side elevational view of the gauge.
Figure 6:
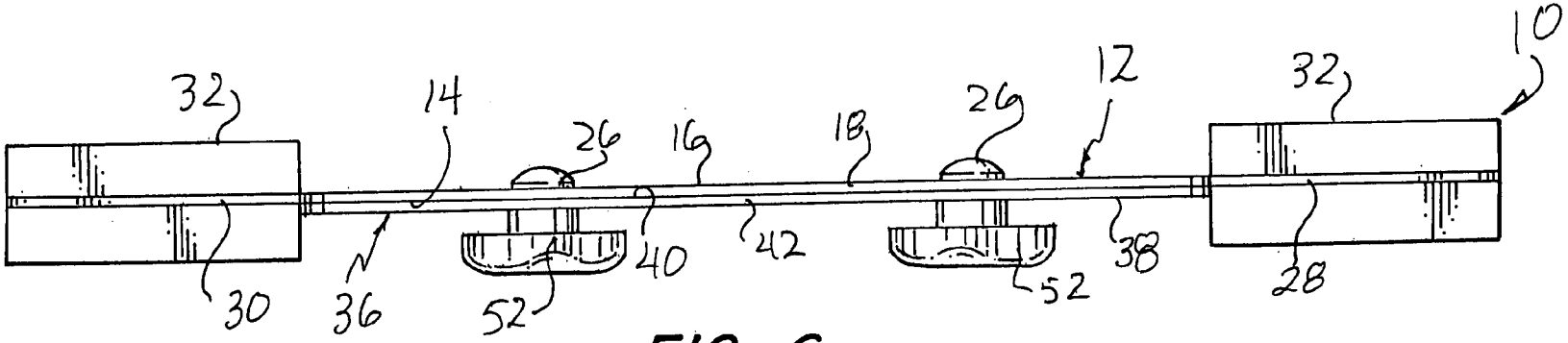
FIG. 6 is a top plan view of the gauge.
Figure 7:
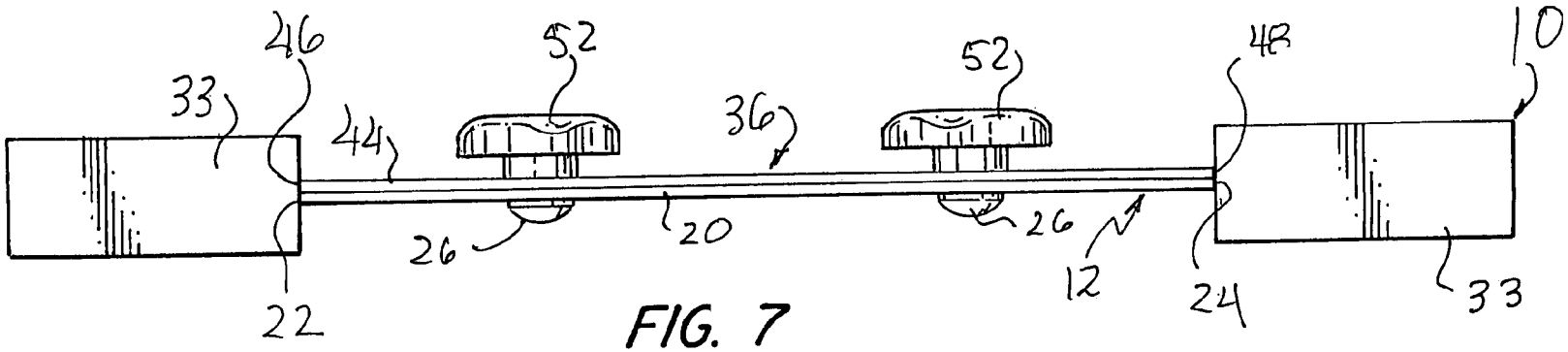
FIG. 7 is a bottom view of the gauge.

As will be noted in FIG. 3, indicia are provided on the components of the gauge described so as to facilitate use and adjustment. In particular, the word "BASE" is applied (by any appropriate means) to the upper arm portion 28 at 54, and the word "SAND" is similarly applied to the lower arm portion 30 at 56. Indicia are also applied at 58 and 60 to the rear face 40 of the screed blade 36, which indicia are visible through the apertures 62 in the panel portion 16 of the guide member 10. The indicia 58, 60 are indicative of the levels at which the layers of the bed would be established, based upon the vertical dimension of the paver being installed. For example, if a paving block is nominally 95 mm high, the gauge components would be adjusted to that relationship in which the "95 mm" mark is visible through the corresponding aperture 62, as depicted in the figure.

The primary members (10, 36) of the gauge will normally be fabricated from a suitable metal, such as steel or aluminum, or from a durable, rigid plastic material; both components need not be made from the same material and, indeed, each may itself of composite construction. The means for assembling the guide and screed members may vary considerably from that which is illustrated, both in respect of the fasteners utilized and also in respect of the slots provided to enable their relative movement. Thus, slots provided need not be perpendicular to the screed edge, and the positions of projecting studs may be reversed; indeed, one stud, and a corresponding slot, may be provided on each member. Although the working, bottom edge of the screed blade will normally be rectilinear, as illustrated, it can also have other shapes, such as may be formed, for example, by angled or square teeth, corrugations, etc. In such instances a rectilinear axis through the edge formation would be used for reference purposes in respect of other elements of the gauge. Additional variations will occur to those skilled in the art, and should be deemed to lie within the concept of the present invention and the scope of the appended claims.

Thus, it can be seen that the present invention provides a bed-depth gauge that is effective for use in distributing materials for forming both the base layer of a bed, for installation of pavers, and also a top layer, such that the layers produced are uniform and of controlled depth. The gauge provided is, in addition, very convenient and facile to use, it allows the installer to reliably set and readily adjust the components so as to establish perfect depths based upon the height of the pavers being installed, and it is of incomplex and inexpensive construction and manufacture.

Having thus described the invention, what is claimed is:

1. A bed-depth gauge comprising: a guide member, a screed member, and means for assembling said guide member and said screed member with one another; said guide member comprising a panel portion having a front face, a rear face, a top edge, a bottom edge, and opposite lateral edges; said screed member having a front face, a rear face, a top edge, a bottom edge, and opposite lateral edges; and said means for assembling disengageably securing said guide member and said screed member to one another with the rear face of said panel portion of said guide member contiguous to said front face of said screed member and for relative movement along a first axis so as to selectively vary the distance between said top edge of said guide member panel portion and said bottom edge of said screed member, while maintaining said bottom edge at an angular orientation generally perpendicular to said first axis; said guide member having first and second arms extending laterally, in opposite directions, beyond said opposite lateral edges of both said guide member panel portion and also said screed member, the bottom of each of said arms having a guide surface thereon extending parallel to said bottom edge of said screed member, said guide surface of said first arm being spaced a first distance from said bottom edge of said guide member panel portion and said guide surface of said second arm being spaced a second distance, less than said first distance, from said bottom edge of said guide member panel portion; said guide member, said screed member, and said means for assembling being constructed, dimensioned, and configured so as to enable said guide member and screed member to be secured to one another throughout a range of positions in which said bottom edge of said screed member lies below said bottom edge of said guide member panel portion.

2. The bed-depth gauge of claim 1 wherein both said guide member panel portion and also said screed member are thin, flat, planar, substantially rectangular, and of substantially the same width; wherein said bottom edge of said screed member is rectilinear; and wherein said contiguous faces of said panel portion and said screed member are in surface contact with one another.

3. The bed-depth gauge of claim 2 wherein said first and second arms are of thin, flat and planar form, having a top and a bottom and extending parallel to the plane of said guide member panel portion, and wherein each of said arms includes a planar contact element on the bottom thereof, disposed perpendicular to the plane of said each arm and providing said guide surface thereon.

4. The bed-depth gauge of claim 3 wherein at least said panel portion and said first and second arms of said guide member are of one-piece, integrally formed construction.

5. The bed-depth gauge of claim 1 wherein said means for assembling comprises a pair of parallel slots, formed through at least one of said guide member panel portion and said screed member, a pair of threaded studs extending from at least the other of said panel portion and said screed member, through said parallel slots, to provide free, projecting threaded end portions, and a pair of threaded fasteners threadably engaged on said threaded end portions of said studs.

6. The bed-depth gauge of claim 5 wherein both of said slots are formed in said screed member and are oriented perpendicular to said rectilinear bottom edge thereof, wherein both of said threaded studs extend from said panel portion of said guide member, and wherein said threaded fasteners comprise hand knobs.

7. The bed-depth gauge of claim 1 wherein said guide member has indicia thereon indicative of the separate functions of the gauge that each of said first and second arms cooperates with said screed member in performing.

8. The bed-depth guide of claim 7 wherein said indicia comprises the word "BASE" on said first arm and the word "SAND" on said second arm.

9. The bed-depth gauge of claim 1 wherein said screed member has indicia thereon indicative of the distance between said rectilinear bottom edge of said screed member and said guide surfaces of said first and second arms.

10. The bed-depth gauge of claim 9 wherein said front face of said screed member has said distance-indicative indicia thereon, and wherein said panel portion of said guide member has at least one aperture therein with and through which said distance-indicative indicia can be aligned and viewed.

* * * * *